US011164487B1

(12) United States Patent
Roan et al.

(10) Patent No.: US 11,164,487 B1
(45) Date of Patent: Nov. 2, 2021

(54) DISPLAY ASSEMBLY

(71) Applicant: Art Guild, Inc., West Deptford, NJ (US)

(72) Inventors: Joseph Michael Roan, Media, PA (US); Konrad Giersz, Philadelphia, PA (US); Ivan Letinic, Manalapan, NJ (US)

(73) Assignee: ART GUILD, INC., West Deptford, NJ (US)

( * ) Notice: Subject to any disclaimer, the term of this patent is extended or adjusted under 35 U.S.C. 154(b) by 0 days.

(21) Appl. No.: 16/737,611

(22) Filed: Jan. 8, 2020

Related U.S. Application Data

(60) Provisional application No. 62/885,501, filed on Aug. 12, 2019.

(51) Int. Cl.
*G09F 13/04* (2006.01)
*G09F 13/22* (2006.01)
*G09F 15/00* (2006.01)

(52) U.S. Cl.
CPC ..... *G09F 13/0413* (2013.01); *G09F 13/22* (2013.01); *G09F 15/0087* (2013.01); *G09F 13/0445* (2021.05); *G09F 2013/222* (2013.01)

(58) Field of Classification Search
CPC ..... G09F 13/0413; G09F 15/0087; G09F 2013/0445; G09F 2007/1813; G09F 2007/183
USPC ..... 40/493, 607.03
See application file for complete search history.

(56) References Cited

U.S. PATENT DOCUMENTS

| | | | | |
|---|---|---|---|---|
| 3,947,987 | A | 4/1976 | Allen | |
| 4,065,904 | A * | 1/1978 | Taylor | A47B 96/1458 211/193 |
| 5,116,204 | A * | 5/1992 | Power | G09F 11/02 40/606.14 |
| 5,315,776 | A | 5/1994 | Strawbridge et al. | |
| 5,482,238 | A * | 1/1996 | Kreiter | A47F 5/0853 211/183 |
| 5,562,459 | A | 10/1996 | Durlach | |
| 6,594,930 | B1 | 7/2003 | Segan et al. | |
| 7,131,619 | B2 | 11/2006 | Krapf et al. | |
| 7,823,307 | B2 * | 11/2010 | Gibbs | G09F 11/02 40/493 |
| 2004/0134110 | A1 * | 7/2004 | Konny | G09F 15/0037 40/607.03 |
| 2012/0112034 | A1 * | 5/2012 | Harris | A47F 5/105 248/535 |

(Continued)

FOREIGN PATENT DOCUMENTS

| | | |
|---|---|---|
| KR | 20-0394339 | 8/2005 |
| KR | 10-1186847 | 10/2012 |
| KR | 10-1862764 | 5/2018 |

*Primary Examiner* — Gary C Hoge
(74) *Attorney, Agent, or Firm* — Volpe Koenig

(57) ABSTRACT

A display assembly that has a support, a mobile mount, a stationary mount, and a display unit. The display unit is supported by the mobile mount and the mobile mount is supported by the stationary mount which is secured to support. The mobile mount and the stationary mount are rotatable with respect to each other and may include undulating patterns that move the display vertically. The support includes a lighting element for backlighting the display and a locating element for positioning the stationary mount on the support.

15 Claims, 20 Drawing Sheets

(56) References Cited

U.S. PATENT DOCUMENTS

2013/0069800 A1* 3/2013 Kosedag ..... E04H 17/161
340/928
2018/0142846 A1* 5/2018 Liu ..... F21S 4/28

* cited by examiner

DISPLAY ASSEMBLY

CROSS REFERENCE TO RELATED APPLICATIONS

This application claims the benefit of U.S. Provisional Application No. 62/885,501, which was filed on Aug. 12, 2019 for DISPLAY ASSEMBLY and is incorporated herein by reference as if fully set forth.

FIELD OF INVENTION

The invention relates generally to a display assembly. More particularly, the invention relates to a multi-piece display assembly that is movable. Most particularly, the invention relates to a movable multi-piece display assembly that has back lighting to illuminate the display.

BACKGROUND

There are a number of known devices for advertising and displaying merchandise. While some of the known display assemblies have found acceptance, there remains a need for a flexible system that is aesthetically pleasing, attention grabbing, and user friendly.

SUMMARY

The Applicant's disclosure provides an attention grabbing and aesthetically pleasing display assembly that incorporates flexibility in the display itself and in lighting the display. The display assembly includes a support on which a display unit is mounted. The mounting is achieved by securing one mount to the display and securing another mount to the support and resting the display mount on the mount secured to the support. The two mounts are free to move relative to each other and render the display unit movable. The two mounts may have undulating mating surfaces which will cause the display unit to move vertically on the support as well as rotating about the support. The display unit can be mobile about the support by moving the first mount relative to the second mount.

The support is preferably tubular and of sufficient length to position the display unit at a desired height. The support preferably includes a number of preconfigured locations or positions where a mount may be secured to the support. In addition, the support preferably includes at least one position or location where a lighting element that selectively backlights the display unit can be secured.

BRIEF DESCRIPTION OF THE DRAWINGS

The following detailed description will be better understood when read in conjunction with the appended drawings, which wherein.

DETAILED DESCRIPTION

Figure 1:
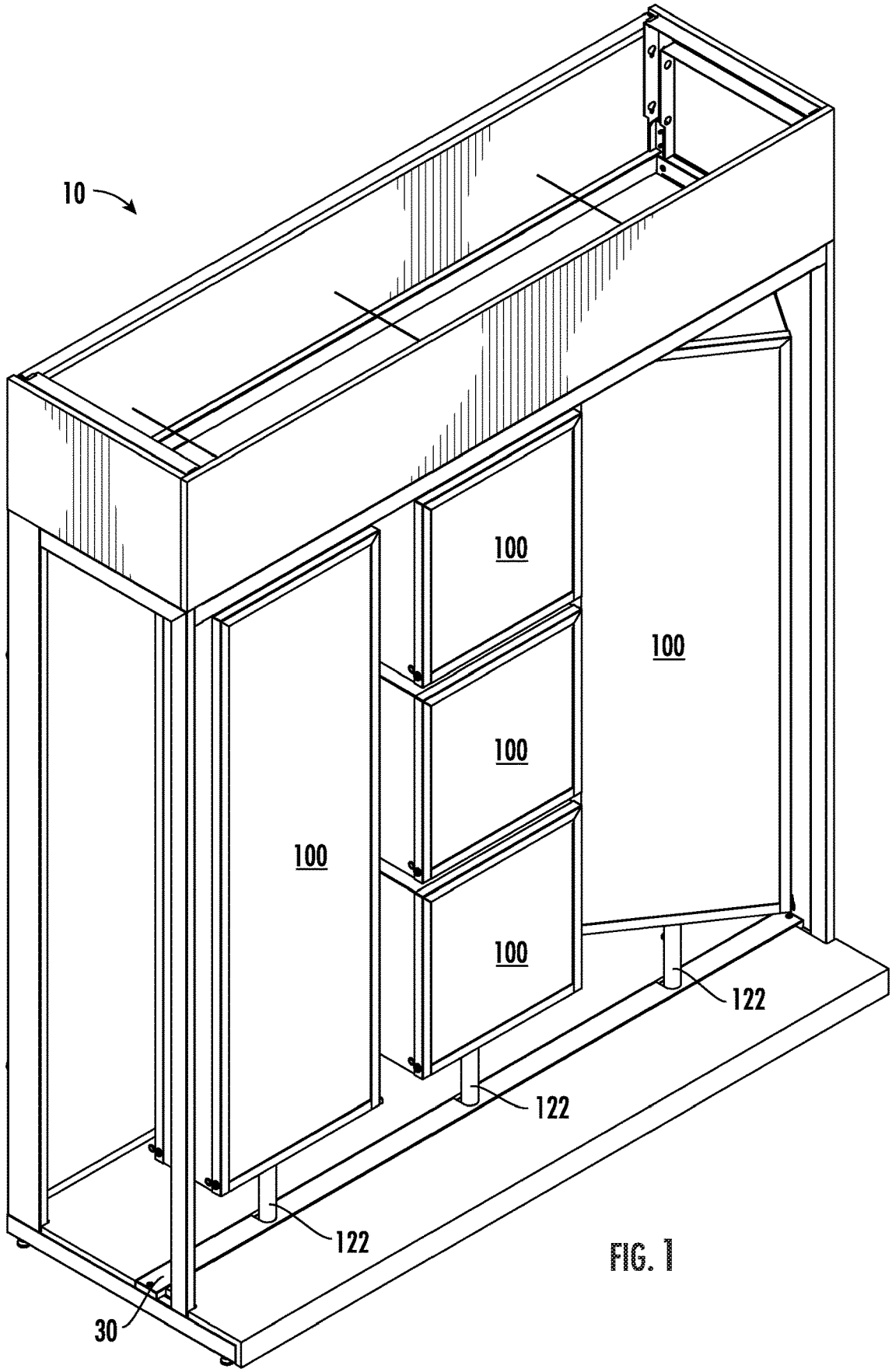
FIG. 1 illustrates a display that incorporates multiple display assemblies according to the presently preferred display units.

With reference now to FIG. 1, there is illustrated a display 10 that includes multiple display units 100. Each of the display units 100 in FIG. 1 has the same structural features and they differ only in their size. The display units 100 are mounted on a support 120. The support 120 may be secured directly to a floor or with a bottom brace 30 in the event the floor is not suitable. There may be a corresponding top brace 20, visible in FIG. 2, for securing the upper end of the support 120. The display units 100 are preferable movable about the support 120 and have back lighting, see FIGS. 2 and 3.

Figure 2:
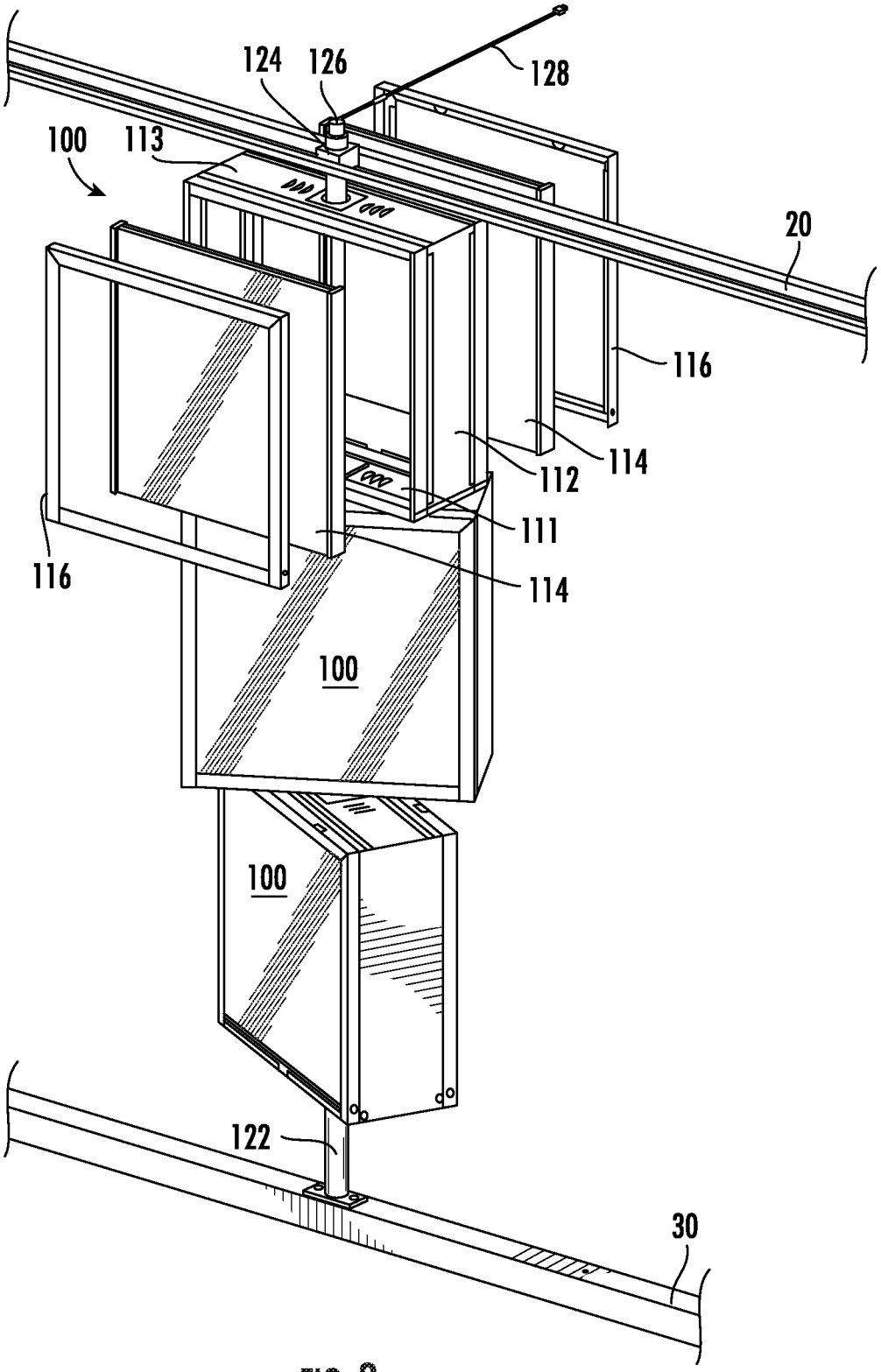
FIG. 2 illustrates one display assembly from FIG. 1 with a display unit shown in an exploded view.

FIG. 2 illustrates the three display units 100 in FIG. 1 with an exploded view of a display unit 100. The relationship of the support 120, bottom mount 122, top mount 124, top brace 20 and a bottom brace 30 can be seen in FIGS. 2 and 3.

As shown in FIG. 2, a display unit 100 includes a frame 112, shown as rectangular in FIG. 2 for the purpose of illustration; however, the frame 112 may be any geometric shape that can be mounted on a support 120. When the display unit 100 is completed and ready for installation, the support 120 extends through the bottom 111 and top 113 of the frame 112. The frame 112 receives at least one graphic display 114, and preferably two graphic displays 114, when it is in a rectangular configuration. Each graphic display 114 is inserted into an open face of the frame 112 and the surround 116 fits over the graphic display 114 and is connected to the frame 112 to secure the graphic display 114 in the frame 112. The surround 116 is akin to a picture frame and it gives the display unit 100 a finished look and enables display changes to be made easily within the same fame 112.

Figure 3:
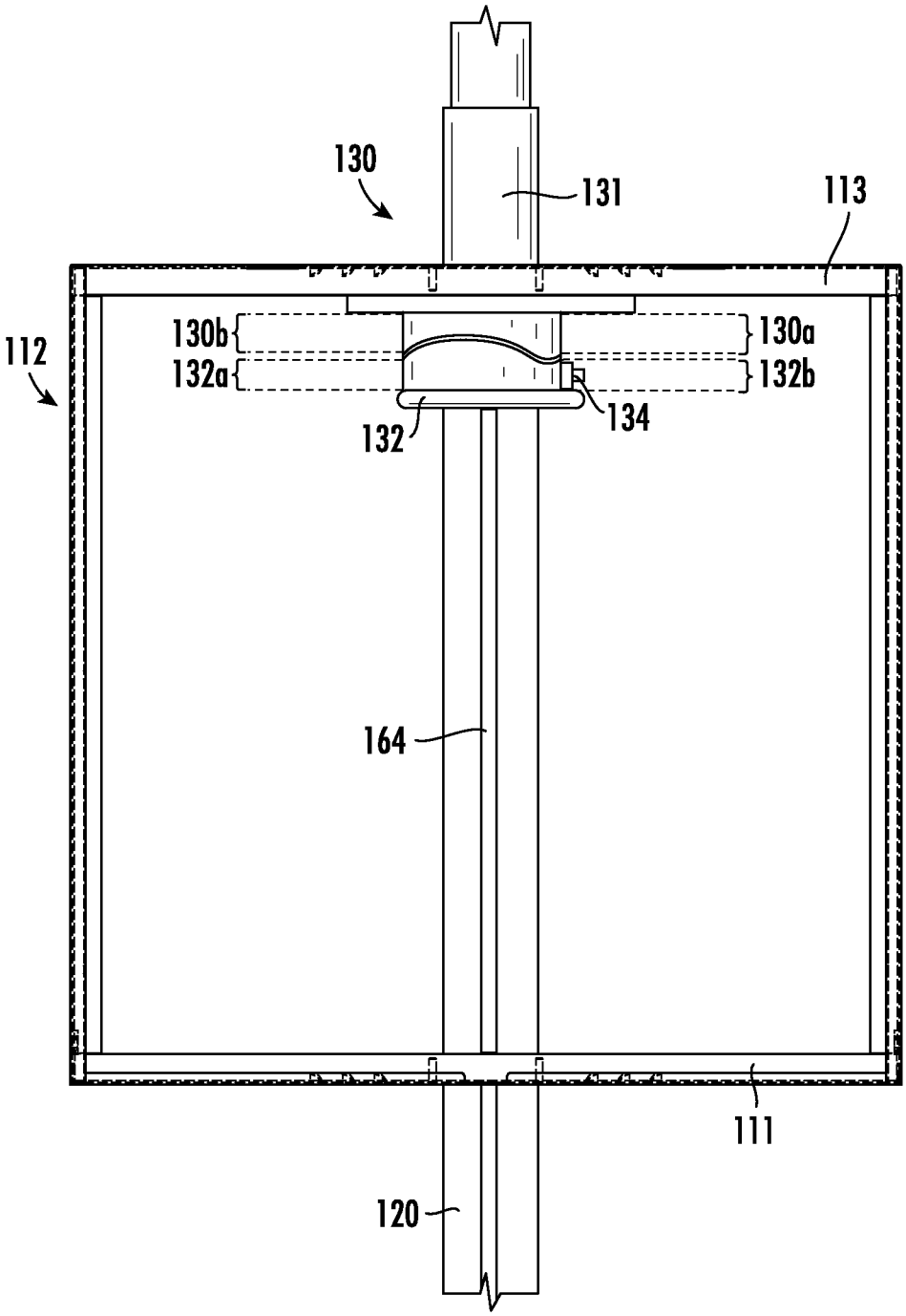
FIG. 3 illustrates the interior of a display unit.
Figure 15:
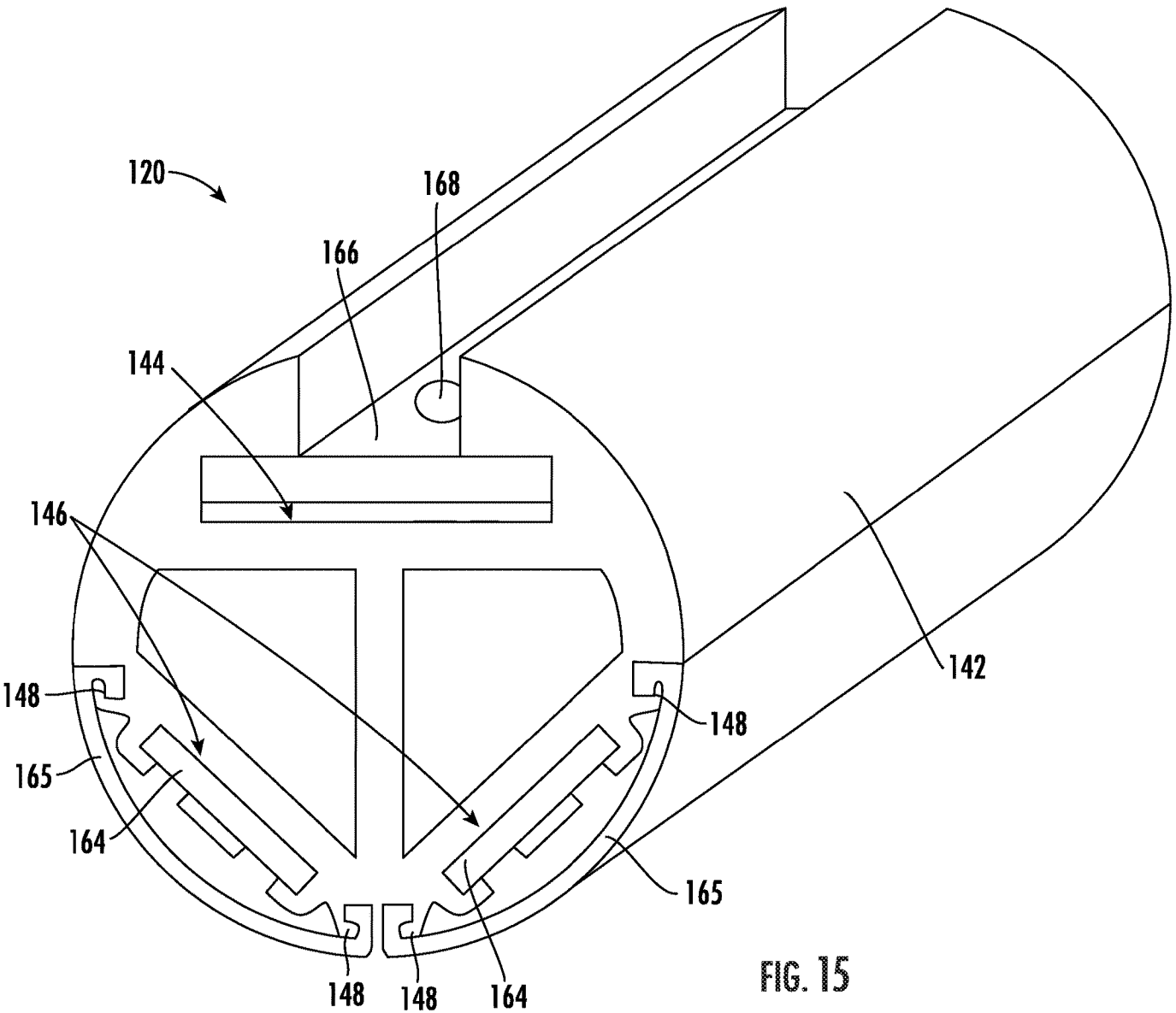
FIG. 15 illustrates a support usable with the display units.
Figure 16:
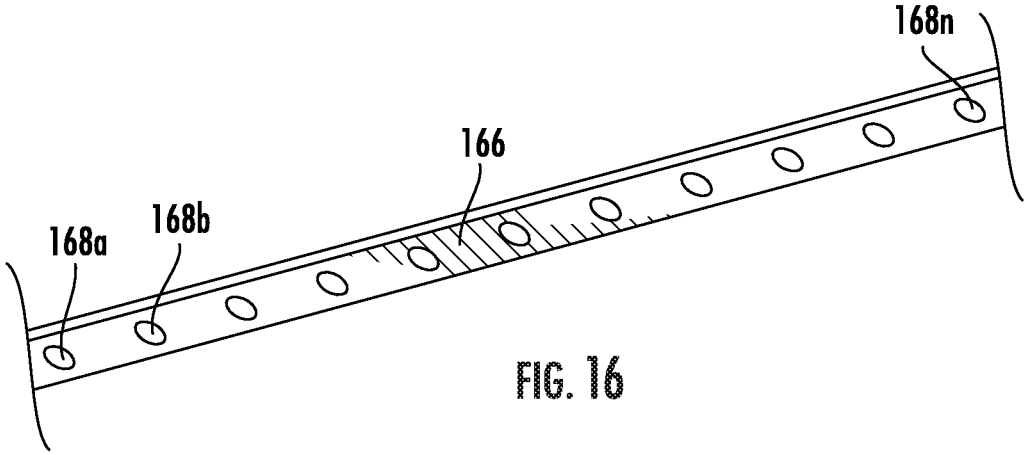
FIG. 16 illustrates a locator strip usable with the support of FIG. 15.

With reference to FIG. 3, each display unit 100 preferable includes an illumination source that back lights the graphic display 114. The illumination source is preferable a lengthwise LED light strip 164, which is low powered and produces minimum heat in the graphic display 114. The electrical leads or wires 128 associated with light strip 164 are routed through an end cap 126, shown in FIG. 16, which is inserted in the support 120. The end cap 126 provides a wire chase to organize the wires 128 associated with the light strip 164. Suitable LED light strips are available from National Lighting, 16826 Edwards Road, Cerritos, Calif. 90703; http:/www.nationalighting.com. As shown in FIGS. 15 and 16, the locator strip 166 fits into a slot in support 120 and provides multiple locations or positions where the display 100 can be secured to the support 120. Further details of these components will be provided hereinafter in connection with FIGS. 15-17.

FIG. 3 illustrates a frame 112 mounted on a support 120. The frame 112 is connected to a first mount 130, which preferably includes a sleeve 131 that extends through the frame 112. The sleeve 131 isolates the light from the lighting element 164 within the display unit 100 and provides a finished cover over the support 120. The first mount 130 is not fastened to the support 120 but is configured to mate with a stationary second mount 132 that is fastened to the support 120 in a selected location along the locator strip 166. The two mounts 130 and 132 may have planar mating surfaces but it is preferred that they have non-planar or undulating mating surfaces. In either case, the mating surfaces make the frame 112 rotatable about the support 120. With the undulating surfaces, the first mount 130 also moves vertically when rotated on the second mount 132.

Figure 4:
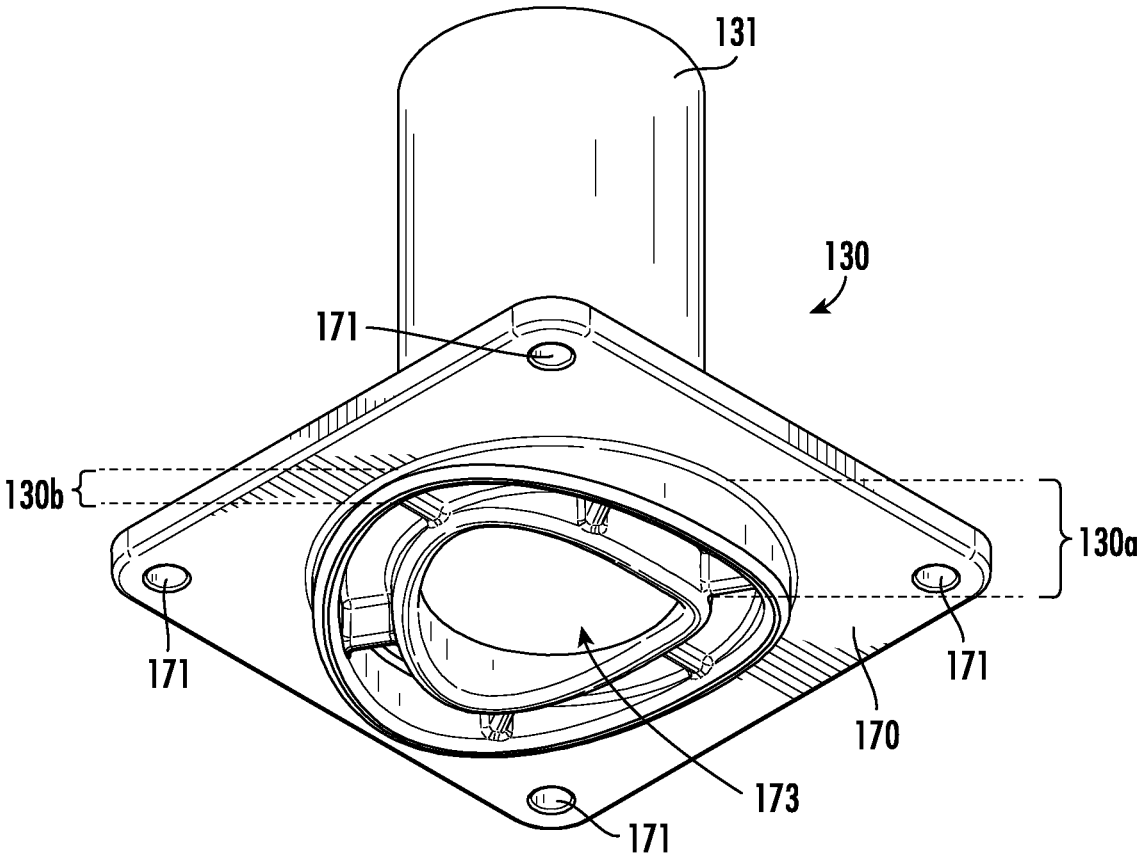
FIG. 4 illustrates a mount usable for attachment to a display unit.
Figure 5:
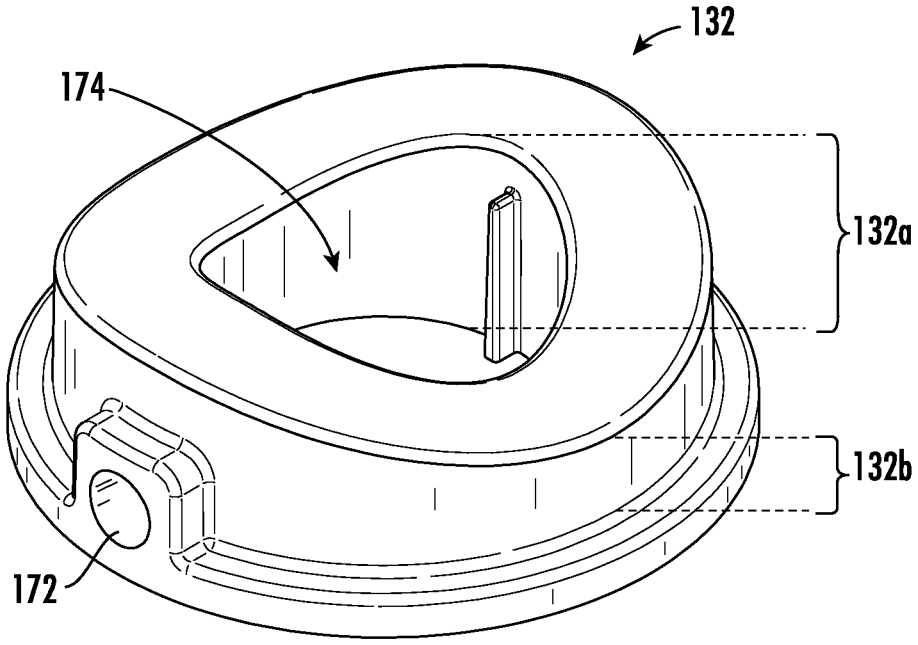
FIG. 5 illustrates a mount usable for securing a display unit to a support.

As the display unit 100 rotates, the first mount 130 that is attached to the frame 112 moves on the undulating surface of the stationary second mount 132. The movement between the first mount 130 and the second mount 132 will raise and lower the frame 112 with the rotation around the support 120. With reference to FIGS. 4 and 5, the first mount 130 and the second mount 132 will be explained in more detail. FIG. 4 illustrates a configuration for the first mount 130 that is configured to index at 180 degrees and FIG. 5 illustrates a complementary configuration for the second mount 132.

As shown in FIG. 4, the first mount 130 includes a plate 170 with an opening 173 so that the support 120 can enter and extend through the sleeve 131. The plate 170 includes a plurality of apertures 171 for fasteners that secure the mount 130 to the underside of the top 113 of the frame 112, as shown in FIG. 3. FIG. 4 also shows the wave pattern of the surface with two crests 130*a* and two valleys 130*b* that are spaced apart to index at 180 degrees.

FIG. 5 shows the corresponding second mount 132 with an opening 174 to allow the support 120 to extend through it. The stationary second mount 132 includes an aperture 172 for a fastener 134, shown in FIG. 3, which connects with a selected location aperture 168 among the plurality of apertures 168*a-n* on locator strip 166, see FIG. 16, to secure the second mount 132 to the support 120. The surface of the second mount 132 preferably has a wave pattern that corresponds to the first mount 130. FIG. 5 shows the wave pattern with two crests 132*a* and two valleys 132*b* that are spaced apart to index at 180 degrees.

Figure 6:
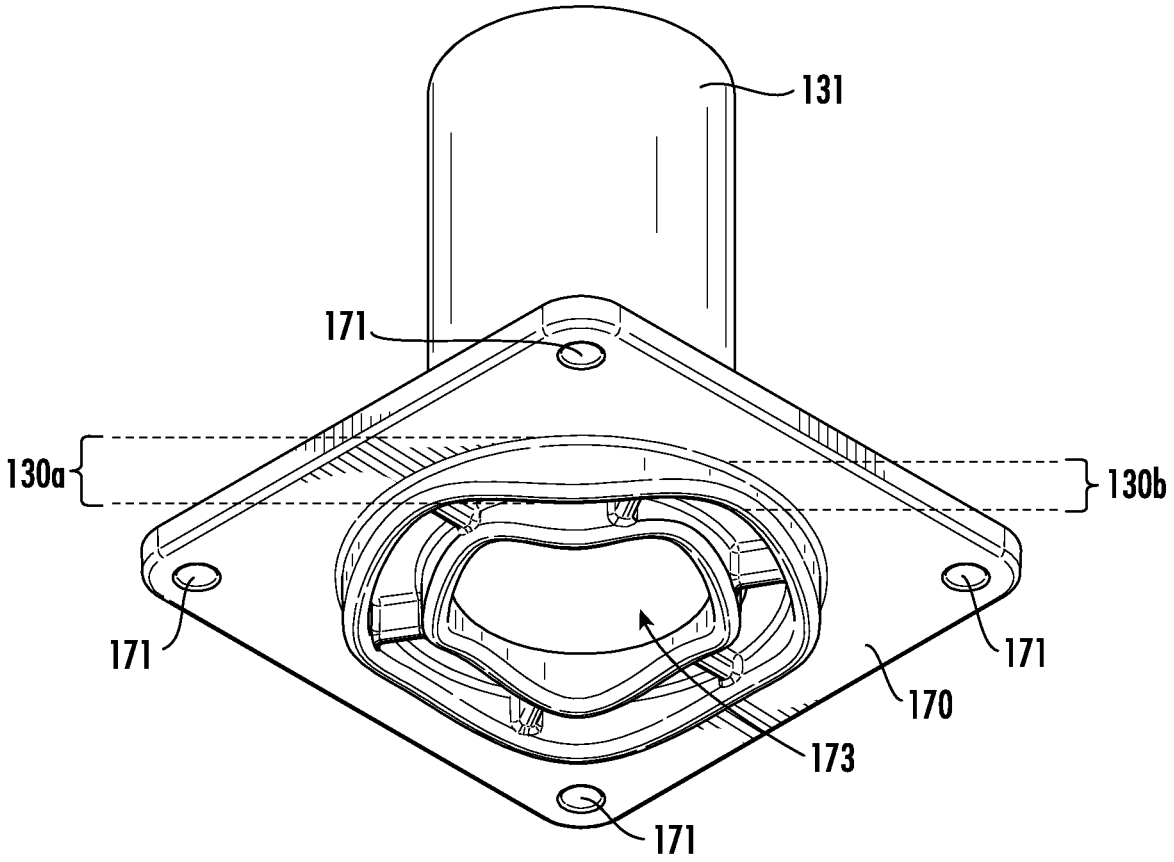
FIG. 6 illustrates an alternative mount usable for attachment to a display unit.
Figure 7:
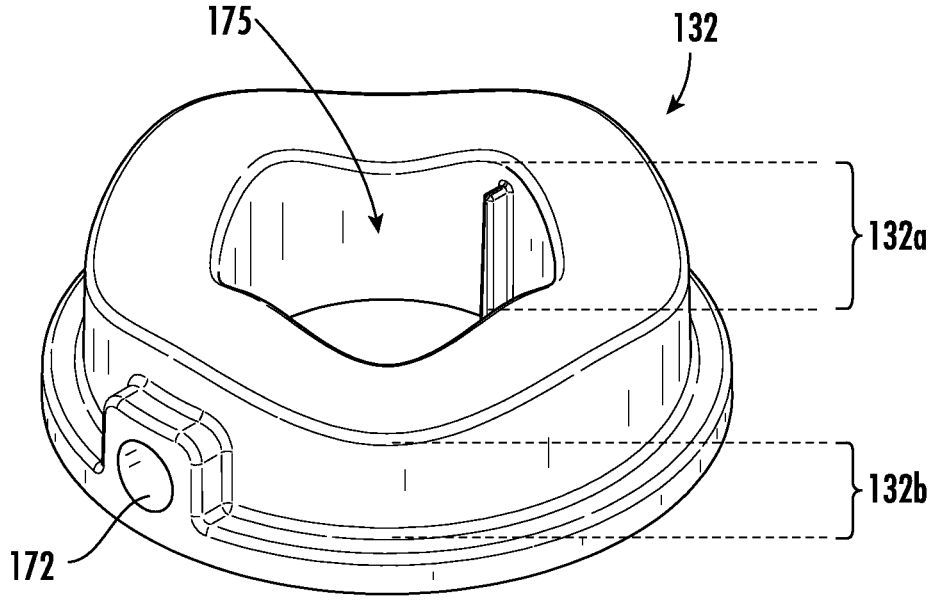
FIG. 7 illustrates an alternative second mount usable for securing a display unit to a support.

FIGS. 6-7 show configurations for the moveable mount 130 and stationary second mount 132 where the undulations, or crest 130*a*, 132*a* and valleys 130*b*, 132*b*, are more frequent and will result in the display unit 100 rotating at 90 degree increments. It will be understood that the undulations can be configured to cause the rotation to be 45 degrees, 60 degrees, or other degrees in accordance with the display unit 100 and the number of face or views that are desired.

Figure 8:
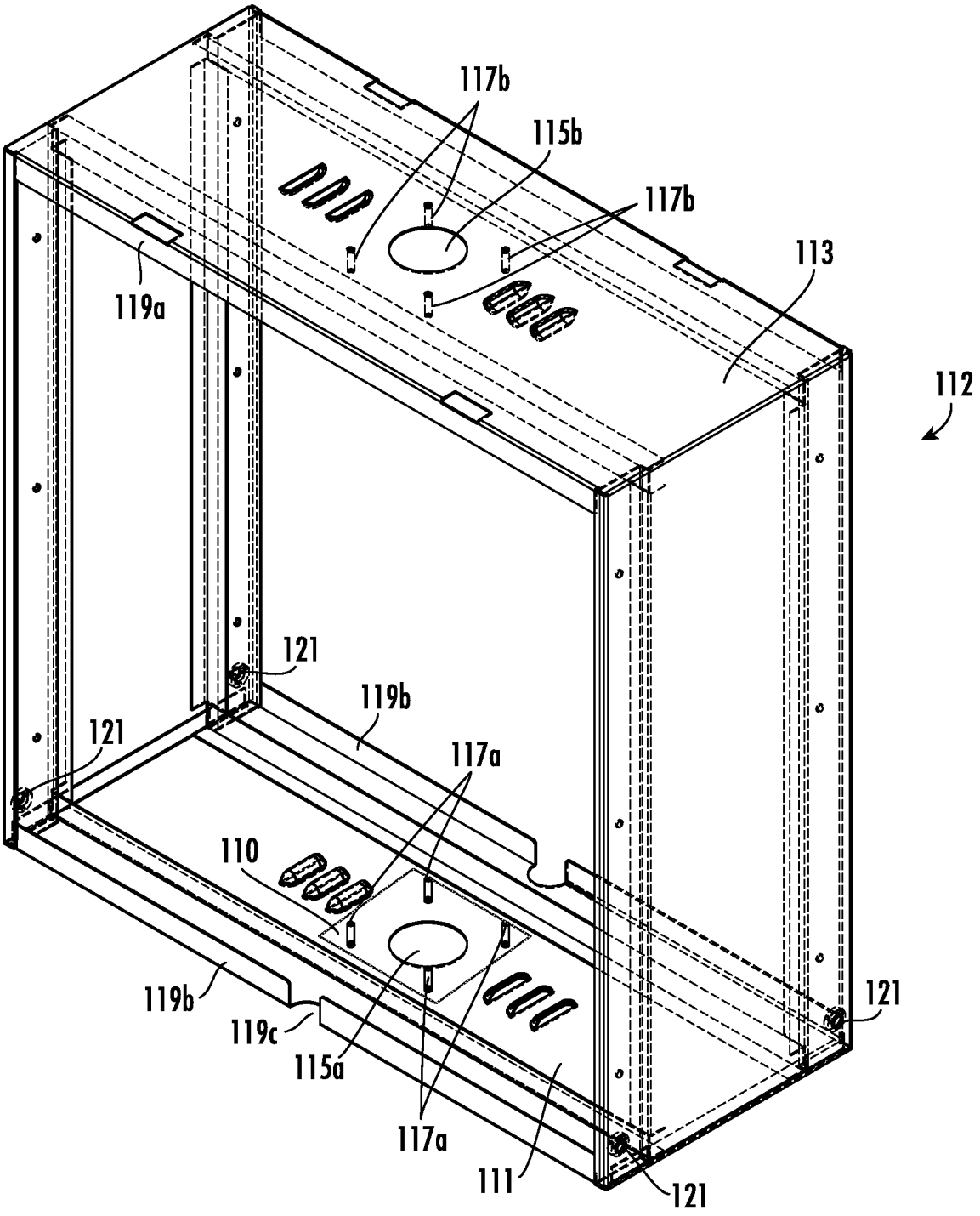
FIG. 8 illustrates the frame of FIG. 3 without any mount or support.

FIG. 8 illustrates the frame 112 apart from the support 120. The frame 112 includes an opening 115*a* in the bottom 111 and an opening 115*b* in the top 113. The opening 115*a* is dimensioned to receive a sleeve that covers the support 120 that is associated with another display unit 100 or is a separator between two displays mounted on the same support 120. When the frame 112 is the bottommost display unit 100, the opening 115*a* can receive a bottom mount 122.

Figure 9:
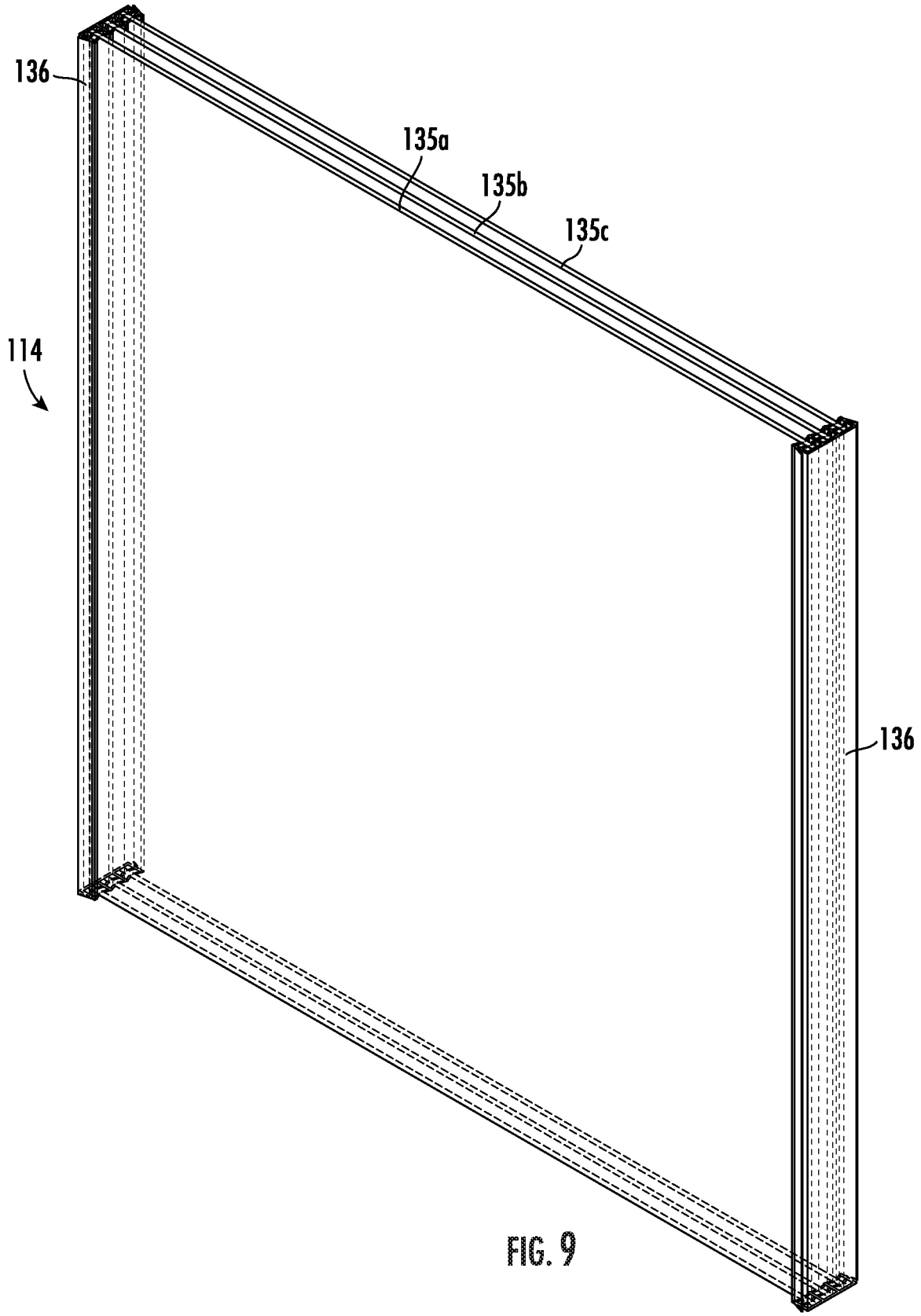
FIG. 9 illustrates a graphic display assembly useable with the frame of FIG. 8.
Figure 10:
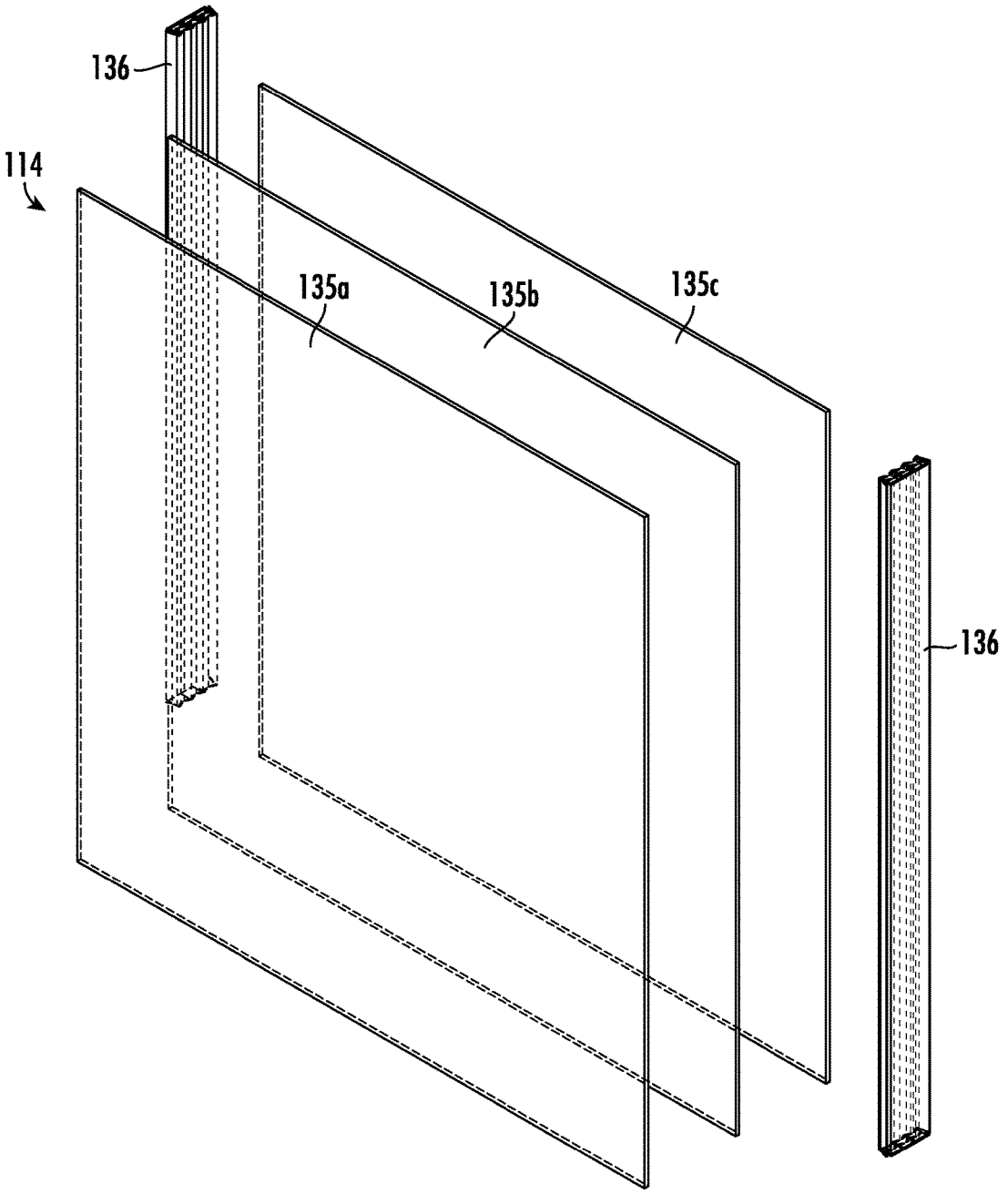
FIG. 10 is an exploded view of the graphic display assembly in FIG. 9.
Figure 11:
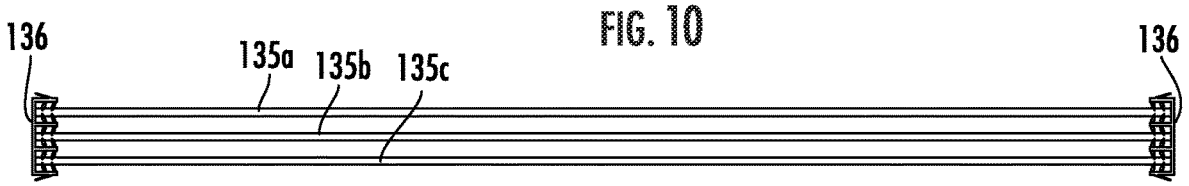
FIG. 11 is a top view of the graphic display assembly in FIG. 9.

In order to protect the structural integrity of the frame 112 it is often desired to attach a plate 110 around the unprotected opening 115*a* or 115*b* as shown in FIG. 8. The plate 110 may be attached with fasteners through apertures 117*a*, 117*b* in the frame 112. It is more typical to use the plate 110 on the bottom 111 of frame 112 because the upper mount, see FIG. 6, typically has a plate 170 and sleeve 131 that provide the desired protection. Still with reference to FIG. 8, the outer edges of the frame 112 include a lip or flange 119*a*, 199*b* that is dimensioned to receive a graphic display 114 as illustrated in FIGS. 9-11. An assembled graphic display can be inserted in the frame 112 raising it under the upper flange 119*a* and lowering it into flange 119*b*. The graphic display can be removed by pushing up at the recess 119*c*.

A preferred technique for assembling a graphic display 114 is illustrated in FIGS. 9-13. In the exemplary graphic display 114 of FIGS. 9-13, three panels 135 *a-c*, are illustrated; however, it will be understood that the desired number of panels will depend on the desired graphics. The panels 135 *a-c* are preferably a material having sufficient strength to be self-supporting to carry any form of message that includes text or graphics. The ends of the individual panels 135 *a-c* are secured by at least two holders 136.

Figure 12:
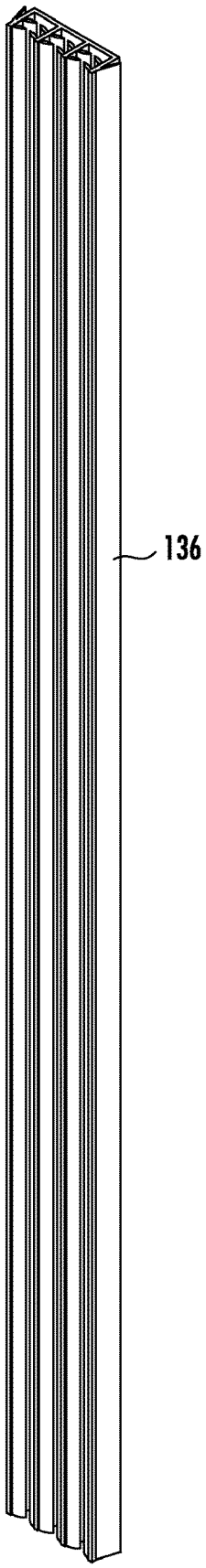
FIG. 12 illustrates an assembly fixture useable for holding the display panels in FIGS. 9 and 10.
Figure 13:
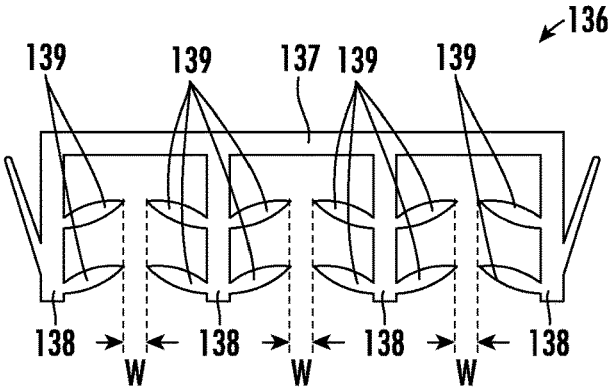
FIG. 13 is a top view of the assembly fixture in FIG. 12.

FIGS. 12-13 show further details of the holder 136. FIG. 12 illustrates a holder 136 for three panels 135. As shown in FIG. 9, the holder 136 will have an outer lip or edge that is dimensioned to complement the flanges 119*a* and 119*b* of the frame 112. With reference to FIG. 13, the holder 136 includes a base 137 and at least two protruding prongs 138. The number of prongs 138 should correspond to the desired number of panels 135 in the graphic display 114. In this configuration, the prongs 138 are more or less evenly spaced; however, the spacing can be altered to obtain a desired effect in the display unit 100 and the dimensions of a given panel 135. The fingers 139 on adjacent prongs 138 are spaces by a distance W that is slightly less than the width of the selected panel 135 *a-c* so the panel 135 *a-c* pushes the fingers 139 in an interference fit that provides a gripping force to hold the panel 135 *a-c*.

Figure 14:
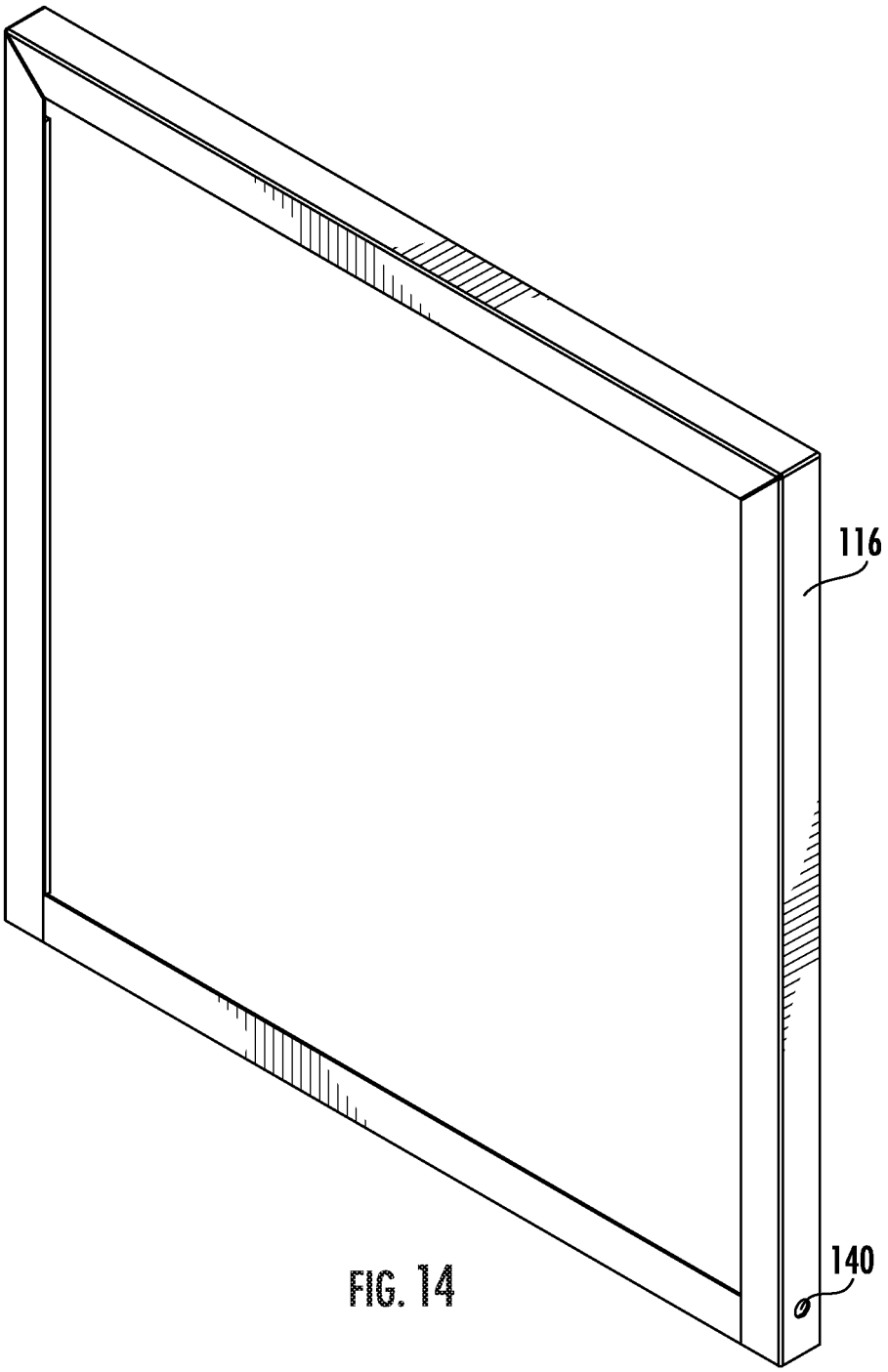
FIG. 14 illustrates a surround usable with the display units in FIG. 2.

FIG. 14 illustrates a surround 116 that is similar to a picture frame and connects to the frame 112 to retain an installed graphic display 114. The surround 116 preferably includes apertures 140 that align with the apertures 121 in the frame 112 so it can be attached and detached for access to the graphic display 114. If accessibility is not a desired feature, the surround 116 may be adhered to the frame 112.

As discussed previously, the panels 135 *a-c* are preferably backlit by a lighting strip 164 in the support 120. FIG. 15 illustrates details of a support 120 that is configured to hold two lighting strips 164 in channels 146, a locator strip 166 in a channel 144, and two lenses 165 over the light strips 164 are retained by the slotted fingers 148. The lens 165 may be a simple dispersing lens or it may have specific effects to enhance the backlighting of the display unit 100. Since the remaining portion 142 of support 120 is solid, it can be customized with additional channels for any desired configuration of the assembly.

FIG. 16 illustrates a locator strip 166 for insertion into the channel 144 with a plurality of apertures 168*a-n* that define location points for securing a fixed mount 132 associated with a display unit 100 on the support 120. The fastener 134 of the mount 132 shown in FIG. 3 engages with one of the plurality of apertures 168*a-n* to secure it in the desired position on the support 120. The specific aperture 168 used to secure the mount 132 will be selected based on a desired position or vertical location of the display unit 100 on the support 120.

Figure 17:
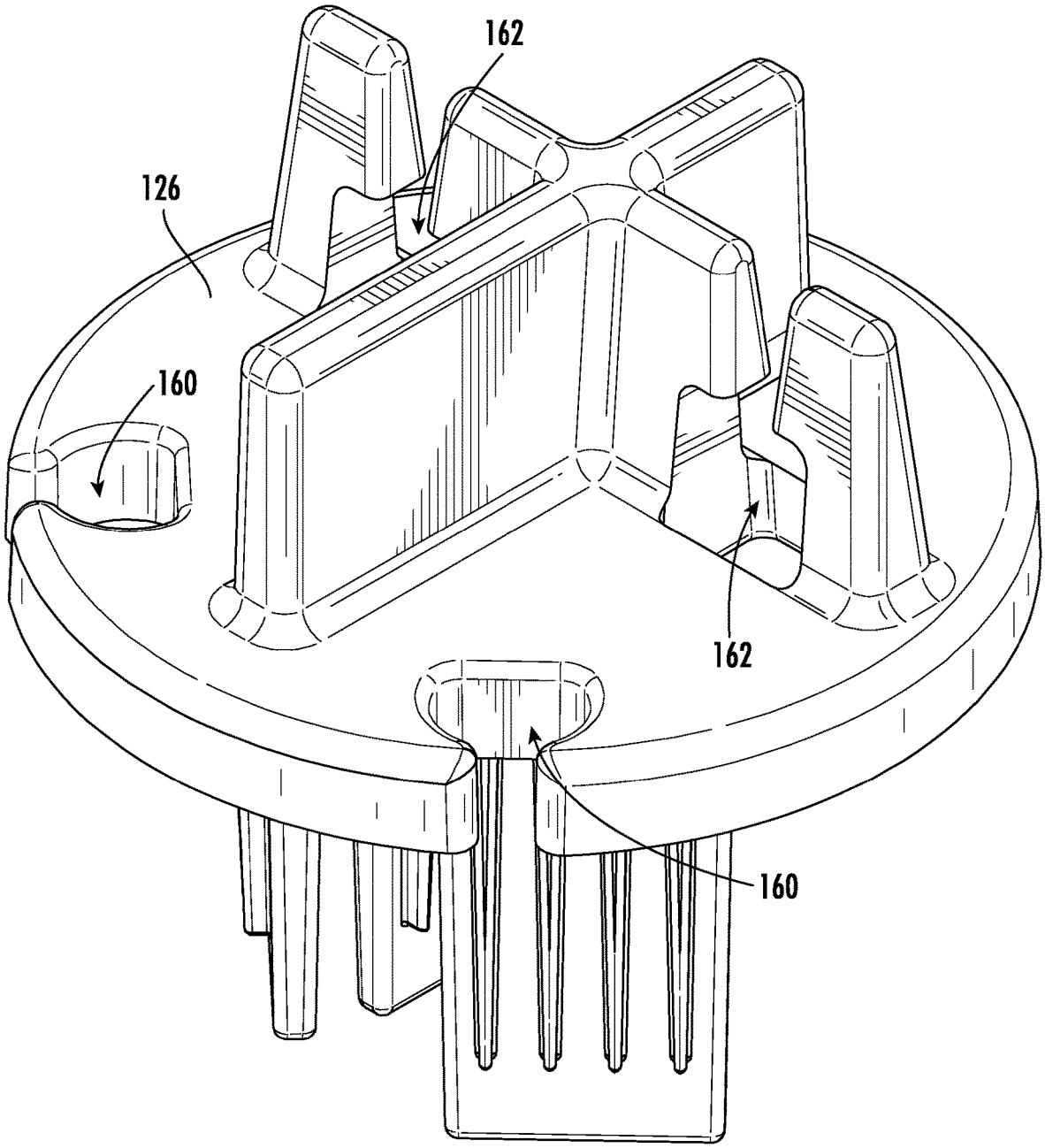
FIG. 17 illustrates a cap for closing an end of the support in FIG. 15.

FIG. 17 illustrates a preferred end cap 126 for closing the support 120. The end cap 126 is dimensioned for an interference fit with the open end of the support 120. In addition to closing the end of the support 120, the cap 126 provides wire chases or routes, 160 and 162, for collecting and directing the wires 128 associated with the lighting strips 164, as illustrated in FIG. 2.

Figure 18:
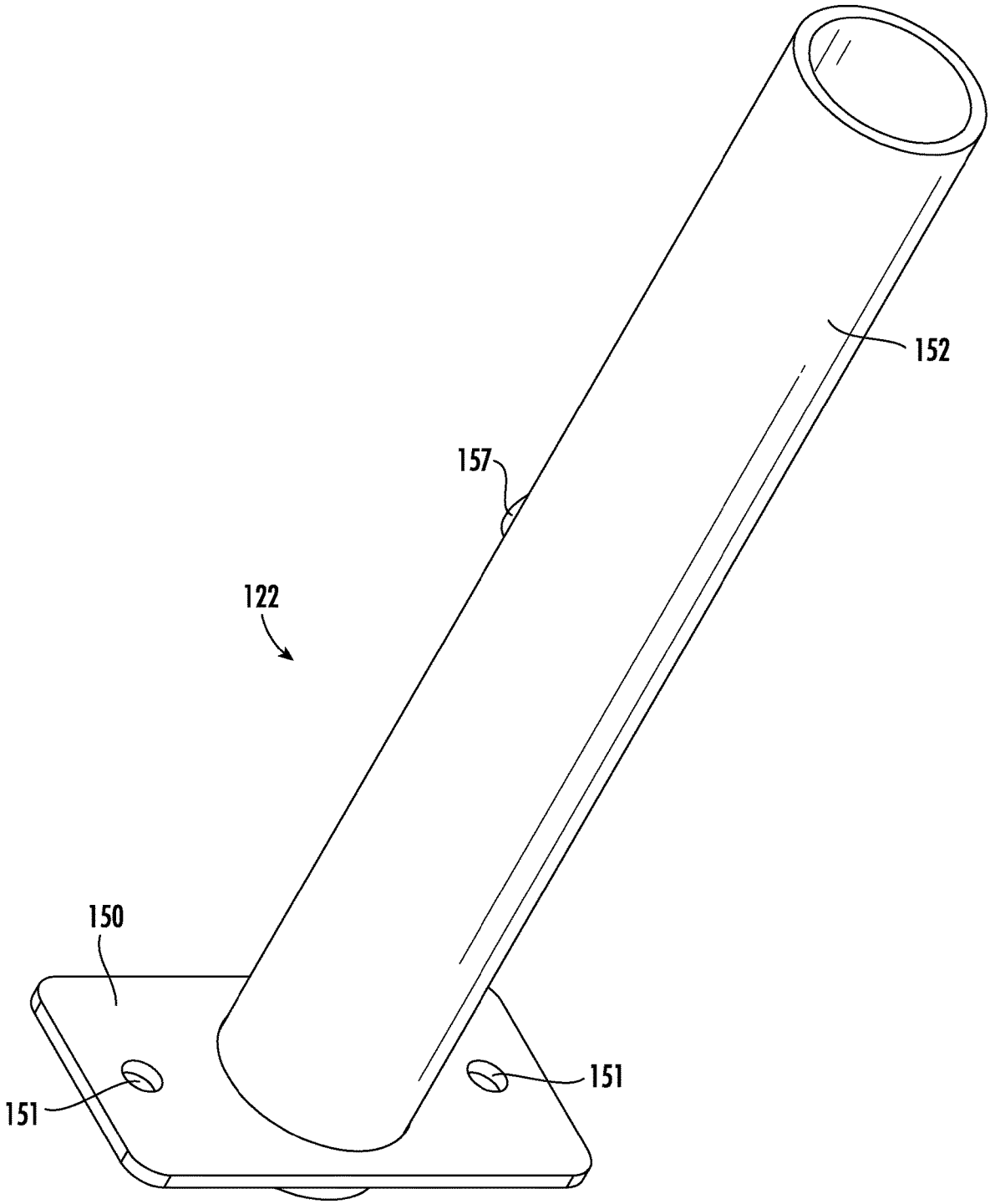
FIG. 18 illustrates a mount usable for securing a display assembly such as that shown in FIG. 1.

FIG. 18 illustrates a mount 122 for securing the bottom of the support 120, such as illustrated in FIG. 2. The bottom mount 122 includes a base plate 150 and a sleeve 152 dimensioned to fit snuggly over the support 120 and the length of sleeve 152 is selected according the potentially exposed support 120. The apertures 151 for fasteners may be provided in any number according to the application and the weight of the display to be secured. If desired, an aperture 157 may be provided for a fastener to secure the mount 122 to the support 120.

Figure 19:
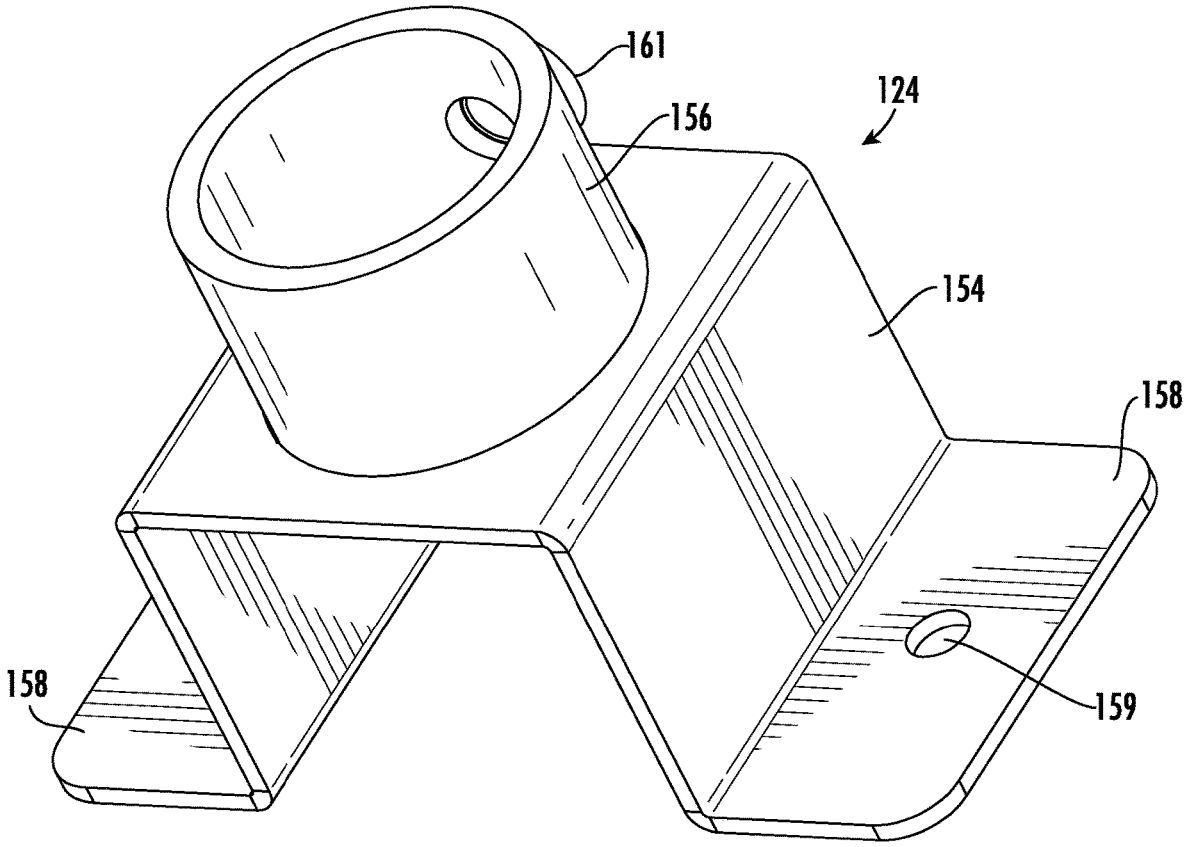
FIG. 19 illustrates another mount usable for securing a display assembly such as that shown in FIG. 1.

FIG. 19 illustrates a mount 124 that is preferred for securing the top of the support 120 in FIG. 2. The mount 124 has flanges 158 on either side of a raised rectangular portion 154 with an aperture that connects with a sleeve 156. The sleeve 156 is configured to snuggly receive the end of the support 120. If desired, an aperture 161 may be provided for a fastener to secure the mount 124 to the support 120. Apertures 159 for fasteners may be provided in any number according to the application and the weight of the display to be secured.

Figure 20:
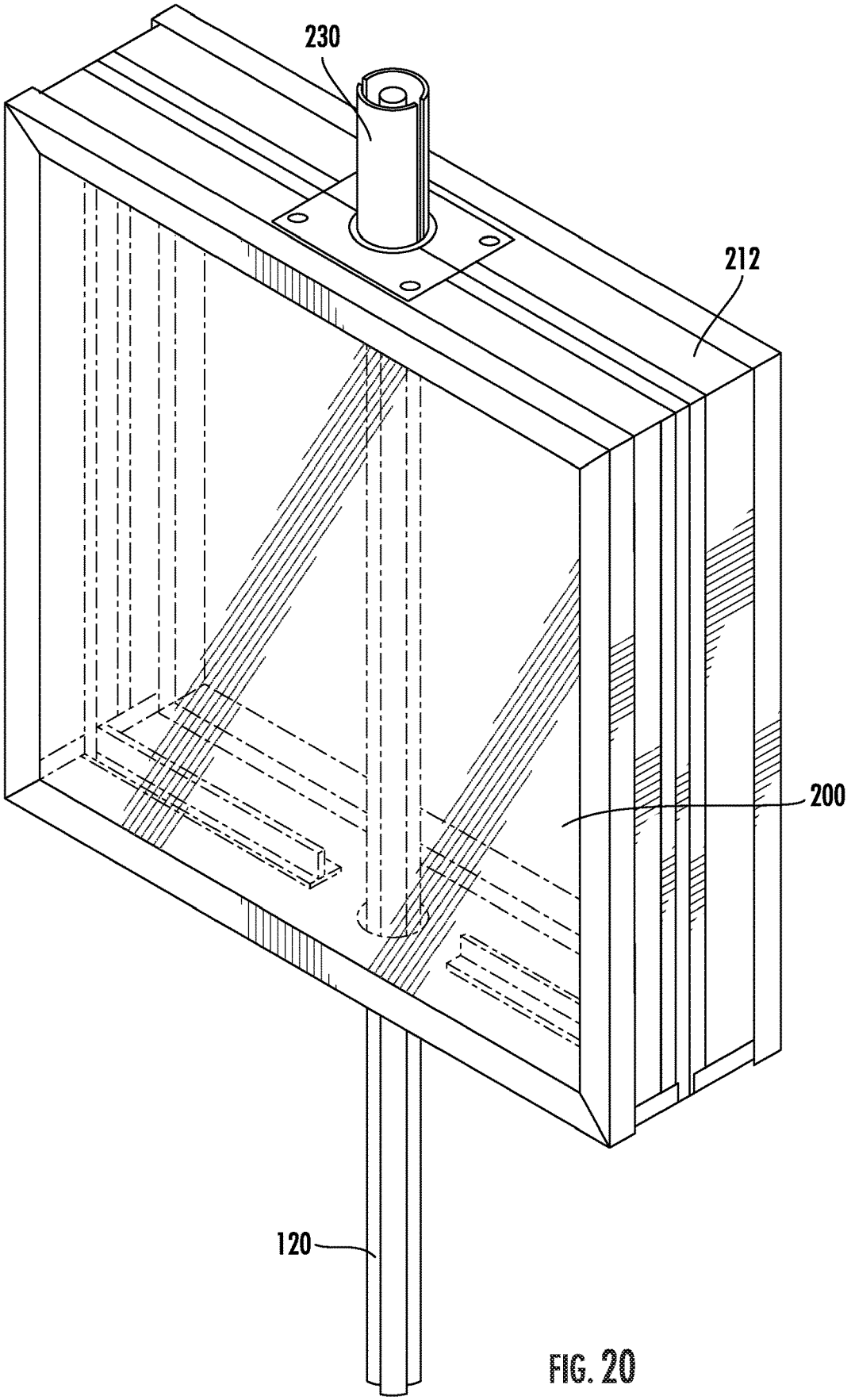
FIG. 20 illustrates a display unit utilizing a second embodiment of the mounts.

FIG. 20 illustrates an alternative embodiment of a display unit 200. This embodiment differs from the prior embodiment in that the frame 212, movable mount 230, and stationary mount 232 are constructed of multiple pieces. With this alternative construction, it is possible to assemble the display unit 200 on a previously installed support 120.

Figure 21:
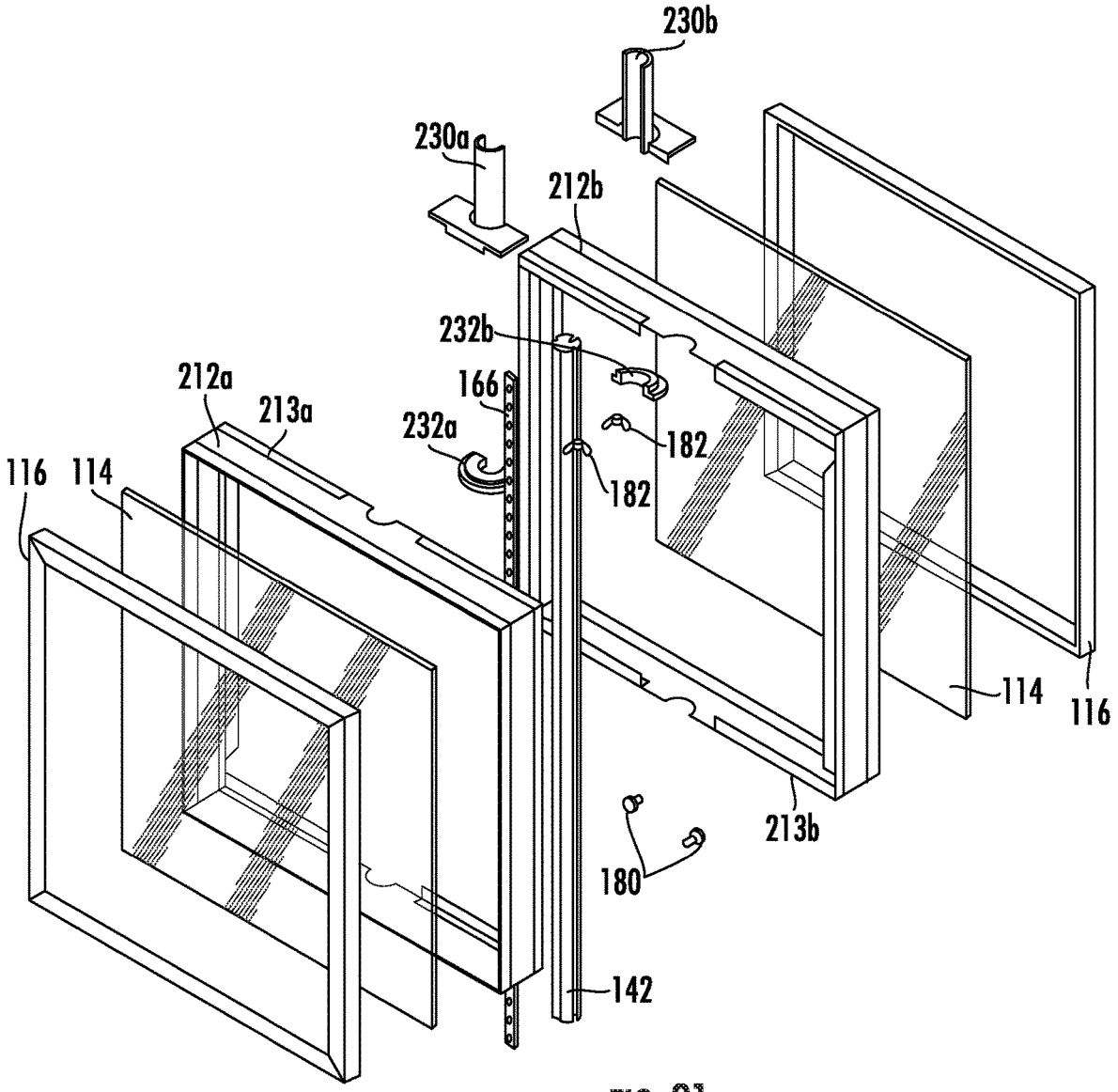
FIG. 21 is an exploded view of the display unit in FIG. 20 utilizing the second embodiment of the mounts.

FIG. 21 is an exploded view of the alternative embodiment from FIG. 20. This embodiment includes a first frame portion 212*a* and a second frame portion 212*b*. The frame portions 212*a*, 212*b* preferably have molded edges 213*a*, 213*b* that overlap and snap together, however, they may be secured with fasteners if desired. Like the prior embodiment, it is preferred that this display be movable.

Figure 22:
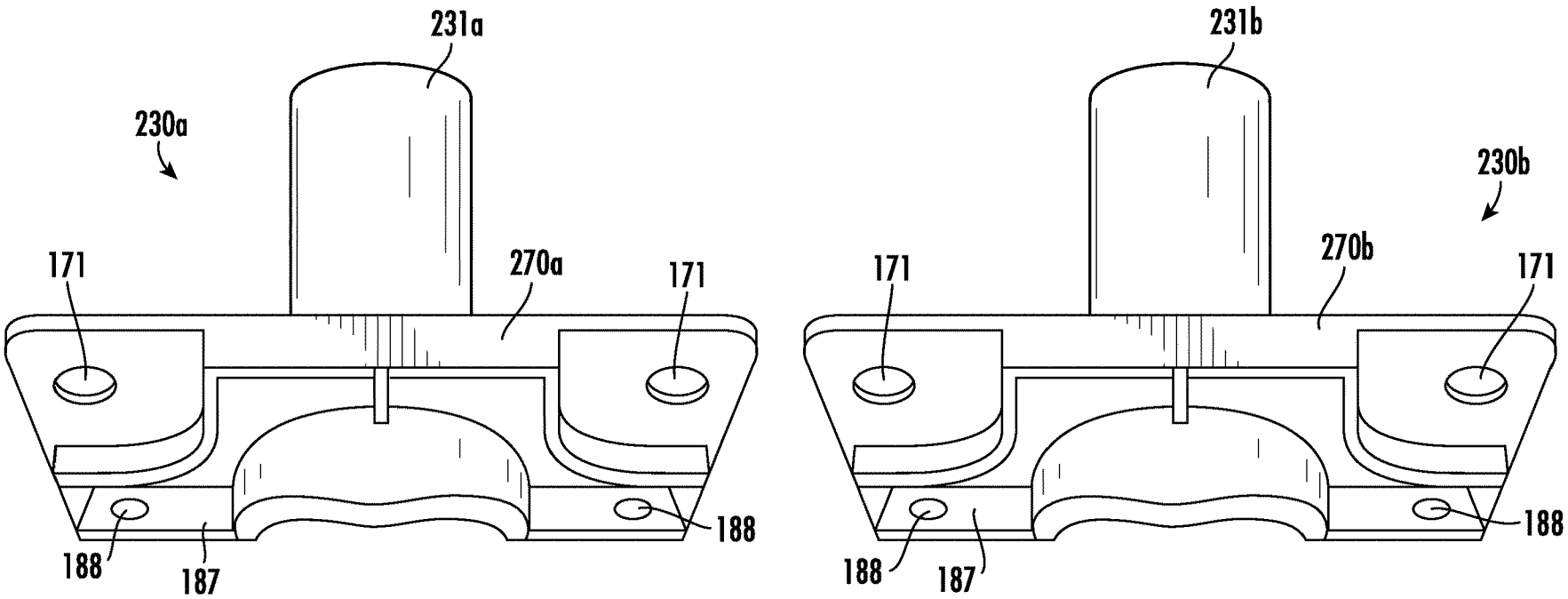
FIG. 22 is a detailed illustration of the second embodiment of a mount for attachment to a display unit.
Figure 23:
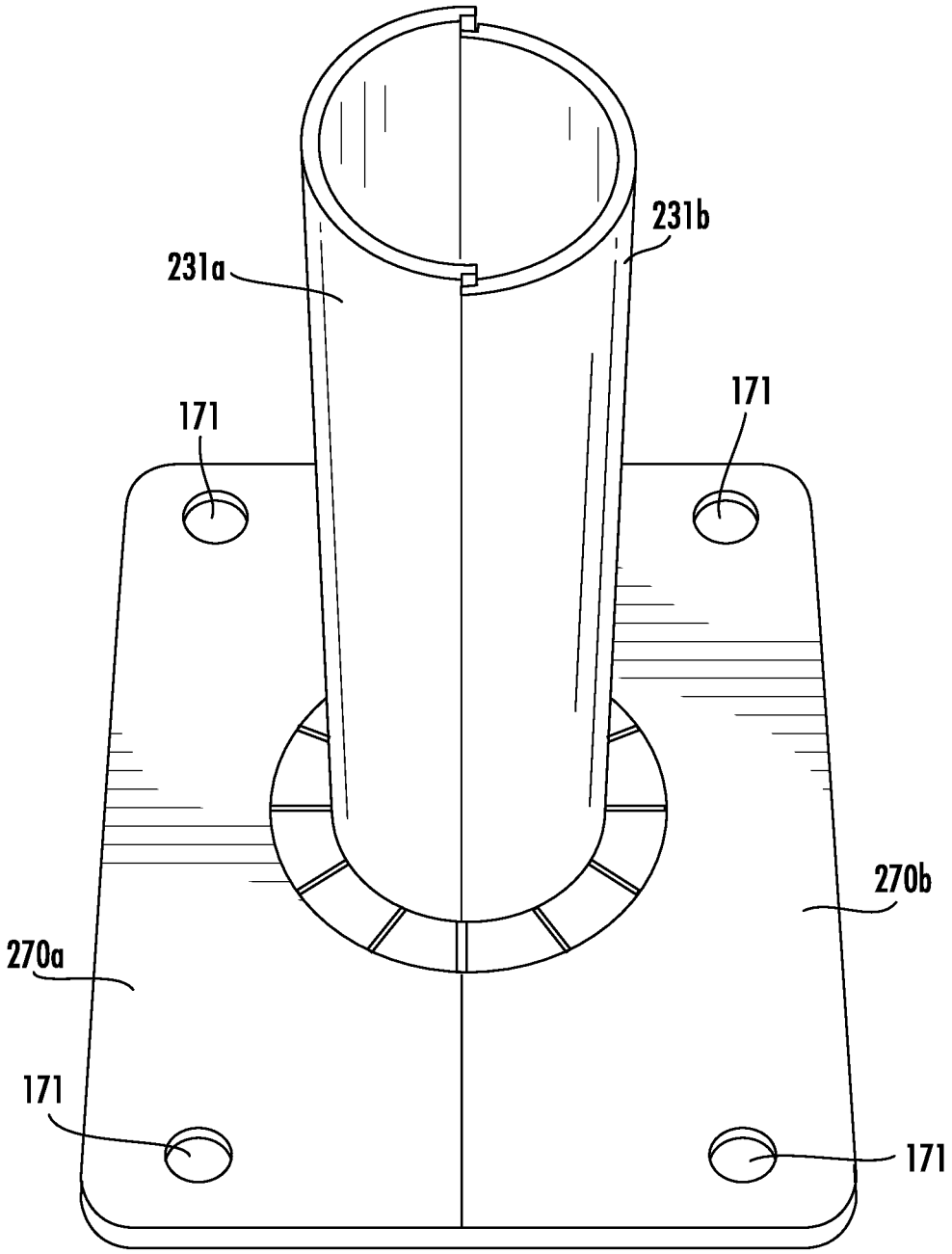
FIG. 23 illustrates an assembly of the mount portions in FIG. 22.

In this configuration, the movable mount 230, see FIGS. 21, 22, and 23, has a first portion 230*a* and a second portion 230*b* that connect together to form a sleeve, 230*a* and 230*b*, and support the two frame halves 212*a* and 212*b*.

FIGS. 22 and 23 further illustrate the mount 230 and the portions 230*a*, 230*b* which include the sleeve portions 231*a*, 231*b* configured to receive the support 120. The mount 230 also includes plates 270*a*, 270*b* that include a plurality of apertures 171 for fasteners for connecting to the frame portions 212*a*, 212*b*, shown in FIG. 20. The plate portions 270*a*, 270*b* also includes dependent flanges 187 that include apertures 188 to receive fasteners for connecting the portions 230*a*, 230*b* around the support 120. The mount 230 preferably includes a wave pattern as previously discussed.

As illustrated in FIG. 23, the free ends of the sleeve formed by sections 231*a* and 231*b* preferably include a molded snap fit, such as a rib and a recess, that provides a locking mechanism that holds them together.

Figure 24:
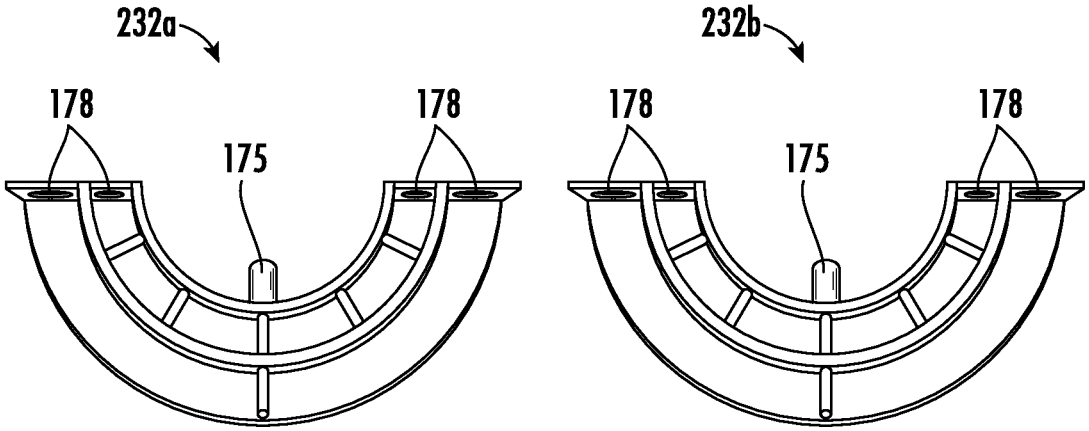
FIG. 24 is a detailed illustration of the second embodiment of a mount for attachment to a support.
Figure 25:
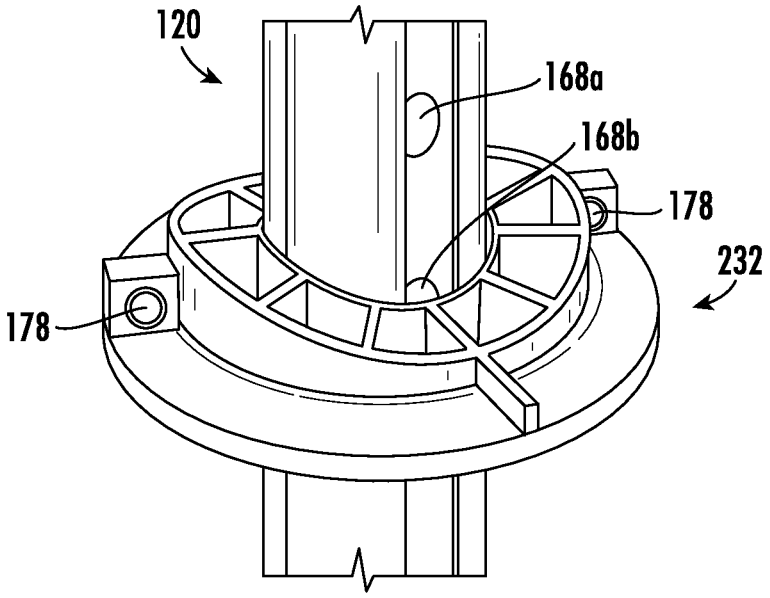
FIG. 25 illustrates an assembly of the mount portions in FIG. 24 secured to a support.

FIGS. 24 and 25 illustrate an alternative stationary mount 232 that includes a first portion 232*a* and a second portion 232*b*. At least one of the portions 232*a*, 232*b* includes a protrusion 175 that is dimensioned for insertion into a selected aperture 168*a-n* of the locator strip 166 to secure the stationary mount 232 at the desired position on support 120. Here again, a plurality of fasteners and apertures 178 are provided to connect the portions 232*a*, 232*b* together. The portions 232*a*, 232*b* may connect via fasteners such as screws 180 and wing nuts 182.

FIG. 25 illustrates this stationary mount 232 assembled on the support 120. As discussed previously, the surface of the stationary mount 232 preferably includes a wave or undulating pattern that complements a wave or undulating pattern on the surface of the movable mount 230.

What is claimed is:

1. A display assembly comprising:

a plurality of multi-sided displays configured to receive a support within the display;

the support passes through each of the displays and includes a plurality of prepositioned apertures extending along the support;

each display of the plurality of multi-sided displays includes a mobile mount that is secured to the display; and each display of the plurality of multi-sided displays includes a stationary mount attached to the support at a selected prepositioned aperture among the plurality of prepositioned apertures and mates with the mobile mount of a selected multi-sided display and fixes the selected multi-sided display at a predetermined location on the support.

2. The display assembly of claim 1, wherein the mobile mount rotates with respect to the stationary mount.

3. The display assembly of claim 1, wherein the support includes a lighting element that backlights the display.

4. The display assembly of claim 3, wherein the support includes an LED.

5. The display assembly of claim 1, wherein the support is tubular and has a longitudinal slot that receives an LED lighting element.

6. The display assembly of claim 1, wherein the support is tubular and has a longitudinal slot that receives a location strip that has a plurality of apertures.

7. The display assembly of claim 1, wherein the support is tubular and has a first longitudinal slot that receives an LED lighting element and a second longitudinal slot that receives a location strip with a plurality of apertures.

8. The display assembly of claim 1, wherein the mobile mount and the stationary mount have corresponding indexing positions and the mobile mount moves between the indexing positions.

9. The display assembly of claim 8, wherein the corresponding indexing positions are offset by 90 degrees.

10. The display assembly of claim 8, wherein the corresponding indexing positions are offset by 180 degrees.

11. The display assembly of claim 1, wherein the predetermined location is selected from a plurality of positioning apertures associated with the support.

12. The display assembly of claim 1, wherein the mobile mount is comprised of at least two portions.

13. The display assembly of claim 1, wherein the stationary mount is comprised of at least two portions.

14. The display assembly of claim 1, wherein the mobile mount is comprised of at least two portions and the stationary mount is comprised of at least two portions.

15. The display assembly of claim 1, wherein the display includes a frame having a first opening and a second opening and at least a first graphic message inserted in one of the first opening and the second opening.

* * * * *